US011487232B1

(12) United States Patent
Omori et al.

(10) Patent No.: US 11,487,232 B1
(45) Date of Patent: Nov. 1, 2022

(54) ENDLESS BELT, FIXING DEVICE, AND IMAGE FORMING APPARATUS

(71) Applicant: FUJIFILM Business Innovation Corp., Tokyo (JP)

(72) Inventors: Kenji Omori, Kanagawa (JP); Hideaki Ohara, Kanagawa (JP); Tomotake Inagaki, Kanagawa (JP); Hitoshi Komuro, Kanagawa (JP); Jun Kimura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/465,268

(22) Filed: Sep. 2, 2021

(30) Foreign Application Priority Data

May 19, 2021 (JP) ..... JP2021-084937

(51) Int. Cl.
*G03G 15/20* (2006.01)

(52) U.S. Cl.
CPC ..... *G03G 15/2057* (2013.01); *G03G 15/2053* (2013.01); *G03G 15/206* (2013.01); *G03G 15/2017* (2013.01); *G03G 2215/2016* (2013.01); *G03G 2215/2048* (2013.01); *G03G 2215/2051* (2013.01); *G03G 2215/2054* (2013.01)

(58) Field of Classification Search
CPC ..... G03G 15/2017; G03G 15/2053; G03G 15/2057; G03G 15/206; G03G 2215/2016; G03G 2215/2048; G03G 2215/2051; G03G 2215/2054
See application file for complete search history.

(56) References Cited

U.S. PATENT DOCUMENTS

| | | | | |
|---|---|---|---|---|
| 8,811,872 | B2 | 8/2014 | Nakagawa et al. | |
| 9,256,176 | B2 | 2/2016 | Miyahara | |
| 9,606,486 | B2 * | 3/2017 | Arai | G03G 15/206 |
| 2015/0309458 | A1 * | 10/2015 | Tamiya | C21D 1/673 399/329 |
| 2015/0367544 | A1 * | 12/2015 | Asaka | B29C 45/14 425/129.1 |

FOREIGN PATENT DOCUMENTS

| | | | |
|---|---|---|---|
| JP | 2012-198516 | A | 10/2012 |
| JP | 2014-228729 | A | 12/2014 |
| JP | 2019-028273 | A | 2/2019 |

* cited by examiner

*Primary Examiner* — Joseph S Wong
(74) *Attorney, Agent, or Firm* — Sughrue Mion, PLLC

(57) ABSTRACT

An endless belt includes a metal substrate, and a heat-resistant resin layer that is disposed as an innermost layer on an inner peripheral surface of the metal substrate and that contains a resin and a thermally conductive filler having an aspect ratio of 20 or more. In the heat-resistant resin layer, an orientation ratio of the thermally conductive filler with respect to a circumferential direction of the endless belt is 20% or more.

20 Claims, 4 Drawing Sheets

ENDLESS BELT, FIXING DEVICE, AND IMAGE FORMING APPARATUS

CROSS-REFERENCE TO RELATED APPLICATIONS

This application is based on and claims priority under 35 USC 119 from Japanese Patent Application No. 2021-084937 filed May 19, 2021.

BACKGROUND

(i) Technical Field

The present disclosure relates to an endless belt, a fixing device, and an image forming apparatus.

(ii) Related Art

Japanese Unexamined Patent Application Publication No. 2012-198516 discloses an image heating device including a flexible tubular film, a nip-part forming member that comes in contact with an inner surface of the film, and a pressurizing member that forms a nip part together with the nip-part forming member with the film interposed therebetween, in which the image heating device heats a recording material carrying a toner image while transporting the recording material in the nip part. In the image heating device, the film has a rough surface portion that satisfies skewness Rsk<0 in a region of an inner surface thereof, the region sliding on the nip-part forming member.

Japanese Unexamined Patent Application Publication No. 2014-228729 discloses a fixing belt that rotates while the inner surface side thereof slides on a backup member, and is used for fixing a toner image on a recording material by heating. The fixing belt includes at least a cylindrical base made of a metal and a sliding layer that is formed on the inner peripheral surface side of the cylindrical base, that slides on the backup member, and that is made of a heat-resistant resin. In the fixing belt, a shape-anisotropic filler is blended in the sliding layer. The filler has an aspect ratio of 5 or more and is oriented such that a length direction of the filler is substantially parallel to a longitudinal direction of the fixing belt.

Japanese Unexamined Patent Application Publication No. 2019-028273 discloses a fixing device including a film body including at least an outermost layer, a base layer, and an inner surface layer, a pressurizing roller that is brought into pressure-contact with the film body to form a nip part, and driving means that rotates the pressurizing roller. By rotating the pressurizing roller, the film is passively rotated, and a recording material is transported while being nipped in the nip part, and is heated and pressurized. In the fixing device, the inner surface layer has a porous shape.

SUMMARY

An endless belt is used as, for example, a fixing belt of a fixing device. In a fixing device, for example, a pressing member and a heat source are disposed on the inner peripheral surface side of an endless belt, and the endless belt rotates while being pressed and heated from the inner peripheral surface side. In this case, the inner peripheral surface of the endless belt slides together with the pressing member or a sliding member disposed between the pressing member and the endless belt. Accordingly, an endless belt having a reduced sliding resistance on the inner peripheral surface thereof has been desired.

In an endless belt including a metal substrate, for example, a heat-resistant resin layer is provided on the inner peripheral surface of the metal substrate to enhance slidability on the inner peripheral surface of the endless belt. However, the formation of the heat-resistant resin layer on the inner peripheral surface of the metal substrate may degrade a thermal conductive property on the inner peripheral surface of the endless belt. When the endless belt has a low thermal conductive property on the inner peripheral surface thereof, heat released from the heat source disposed inside the endless belt may tend to accumulate in the endless belt, and the time taken for the endless belt to reach a fixing temperature may be long.

Aspects of non-limiting embodiments of the present disclosure relate to an endless belt including a metal substrate, and a heat-resistant resin layer that is disposed as an innermost layer on an inner peripheral surface of the metal substrate and that contains a resin and a thermally conductive filler having an aspect ratio of 20 or more, the endless belt having a high thermal conductive property on the inner peripheral surface thereof while having a reduced sliding resistance on the inner peripheral surface compared with the case where an orientation ratio of the thermally conductive filler with respect to a circumferential direction of the endless belt is less than 20%, or the heat-resistant resin layer has, on an inner peripheral surface thereof, an arithmetical mean roughness Ra of less than 0.01 μm or more than 1.2 μm, or a mean spacing Sm of irregularities of less than 10 μm or more than 500 μm in a width direction of the endless belt.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an endless belt including a metal substrate, and a heat-resistant resin layer that is disposed as an innermost layer on an inner peripheral surface of the metal substrate and that contains a resin and a thermally conductive filler having an aspect ratio of 20 or more, in which an orientation ratio of the thermally conductive filler with respect to a circumferential direction of the endless belt is 20% or more.

BRIEF DESCRIPTION OF THE DRAWINGS

Exemplary embodiments of the present disclosure will be described in detail based on the following figures, wherein.

DETAILED DESCRIPTION

Endless Belt

First Exemplary Embodiment

Figure 1:
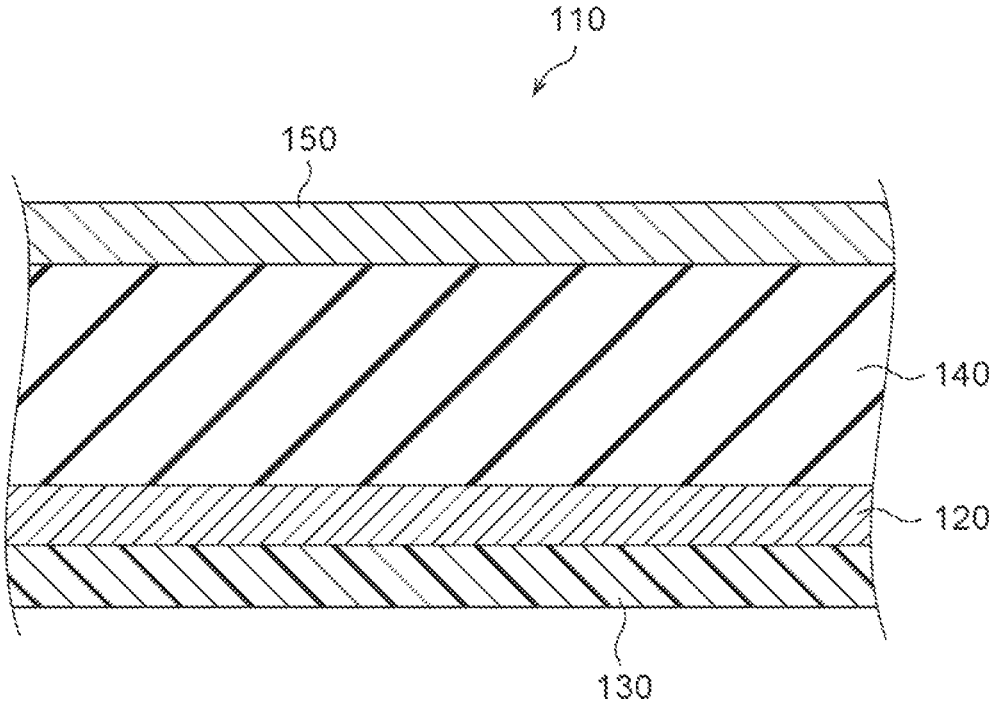
FIG. 1 is a schematic view illustrating an example of the layer structure of an endless belt according to the exemplary embodiment.

An endless belt according to a first exemplary embodiment includes a metal substrate, and a heat-resistant resin layer that is disposed as an innermost layer on an inner peripheral surface of the metal substrate and that contains a resin and a thermally conductive filler having an aspect ratio of 20 or more, in which an orientation ratio of the thermally conductive filler with respect to a circumferential direction of the endless belt is 20% or more. Hereinafter, the orientation ratio of a thermally conductive filler with respect to the circumferential direction of an endless belt is also referred to as an "orientation ratio (circumferential direction) A".

As described above, in an endless belt including a metal substrate, for example, a heat-resistant resin layer is provided on the inner peripheral surface of the metal substrate to enhance slidability on the inner peripheral surface of the endless belt. However, the formation of the heat-resistant resin layer on the inner peripheral surface of the metal substrate may degrade a thermal conductive property on the inner peripheral surface of the endless belt.

When the endless belt has a low thermal conductive property on the inner peripheral surface thereof, heat may tend to accumulate in the endless belt, and it may become difficult to continuously fix an image on a recording medium (hereinafter, also referred to as a "small-size medium") having a width smaller than a heating width of the endless belt in the width direction. Specifically, in the width direction of the endless belt, in a region through which a small-size medium passes, heat is easily removed by the contact with the small-size medium, whereas in a region through which a small-size medium does not pass, heat is not removed but is accumulated, and the temperature is partially increased, which may result in a difficulty of continuous image fixing.

Moreover, when the endless belt has a low thermal conductive property on the inner peripheral surface thereof, the heat quantity necessary for the endless belt to reach a fixing temperature increases, which may result a long warm-up time of the fixing device.

In contrast to this, in the first exemplary embodiment, the heat-resistant resin layer disposed as an innermost layer on the inner peripheral surface of the metal substrate contains a resin and a thermally conductive filler having an aspect ratio of 20 or more, and an orientation ratio (circumferential direction) A of the thermally conductive filler is 20% or more.

Accordingly, since the heat-resistant resin layer contains the thermally conductive filler oriented in one direction, the heat-resistant resin layer has an improved thermal conductive property compared with a heat-resistant resin layer that does not contain a thermally conductive filler. That is, the thermal conductive property on the inner peripheral surface of the endless belt is improved. Consequently, a partial temperature increase caused when an image is continuously fixed to a small-size medium is reduced, and the warm-up time of the fixing device is also shortened.

In addition, since the heat-resistant resin layer contains the thermally conductive filler oriented in the circumferential direction of the endless belt, sliding resistance on the inner peripheral surface of the endless belt is reduced compared with the case where the thermally conductive filler is oriented in the width direction of the endless belt and the case where the thermally conductive filler is not contained. Although the reason for this is not clear, the reason is inferred as follows. Irregularities on the inner peripheral surface of the heat-resistant resin layer due to the thermally conductive filler extend along the circumferential direction of the endless belt. This stabilizes, during rotation of the endless belt, a contact state of a pressing member or a sliding member with respect to the inner peripheral surface of the heat-resistant resin layer, and the sliding resistance is thereby reduced.

A high sliding resistance on the inner peripheral surface of the endless belt may cause, for example, an increase in the rotational load of the endless belt, a shift of the endless belt in the width direction during rotation (that is, meandering of the endless belt), and generation of an unusual sound. However, in the first exemplary embodiment as described above, since the sliding resistance on the inner peripheral surface of the endless belt is reduced, for example, an increase in the rotational load of the endless belt, a shift of the endless belt in the width direction, and generation of an unusual sound are also suppressed.

The endless belt of the first exemplary embodiment has a high thermal conductive property on the inner peripheral surface while having a reduced sliding resistance on the inner peripheral surface probably because of the reasons described above.

Second Exemplary Embodiment

An endless belt according to a second exemplary embodiment includes a metal substrate, and a heat-resistant resin layer that is disposed as an innermost layer on an inner peripheral surface of the metal substrate and that contains a resin and a thermally conductive filler having an aspect ratio of 20 or more, in which, on an inner peripheral surface of the heat-resistant resin layer, an arithmetical mean roughness Ra is 0.01 μm or more and 1.2 μm or less, and a mean spacing Sm of irregularities is 10 μm or more and 500 μm or less in a width direction of the endless belt.

As described above, in an endless belt including a metal substrate, when a heat-resistant resin layer is provided on the inner peripheral surface of the metal substrate to enhance slidability on the inner peripheral surface of the endless belt, a thermal conductive property on the inner peripheral surface of the endless belt may be degraded.

In contrast to this, in the second exemplary embodiment, the heat-resistant resin layer which is an innermost layer contains a resin and a thermally conductive filler having an aspect ratio of 20 or more and has, on an inner peripheral surface thereof, an arithmetical mean roughness Ra of 0.01 μm or more and 1.2 μm or less and a mean spacing Sm of irregularities of 10 μm or more and 500 μm or less in a width direction of the endless belt.

Accordingly, since the heat-resistant resin layer contains the thermally conductive filler, the heat-resistant resin layer has an improved thermal conductive property compared with a heat-resistant resin layer that does not contain a thermally conductive filler. That is, the thermal conductive property on the inner peripheral surface of the endless belt is improved. Consequently, a partial temperature increase caused when an image is continuously fixed to a small-size medium is reduced, and the warm-up time of the fixing device is also shortened.

In addition, since the heat-resistant resin layer has, on the inner peripheral surface thereof, an arithmetical mean roughness Ra of 0.01 μm or more and 1.2 μm or less and a mean spacing Sm of irregularities of 10 μm or more and 500 μm or less in the width direction of the endless belt, the sliding resistance on the inner peripheral surface of the endless belt is reduced compared with the case where the arithmetical mean roughness Ra and the mean spacing Sm of irregularities are out of the above ranges. Although the reason for this is not clear, the reason is inferred as follows. The inner peripheral surface of the heat-resistant resin layer has appropriate irregularities at appropriate intervals in the width direction of the endless belt. This stabilizes, during rotation of the endless belt, a contact state of a pressing member or a sliding member with respect to the inner peripheral surface of the heat-resistant resin layer, and the sliding resistance is thereby reduced. Since the sliding resistance is reduced, for example, an increase in the rotational load of the endless belt, a shift of the endless belt in the width direction, and generation of an unusual sound are also suppressed.

The endless belt of the second exemplary embodiment has a high thermal conductive property on the inner peripheral surface while having a reduced sliding resistance on the inner peripheral surface probably because of the reasons described above.

Hereinafter, an endless belt that corresponds to each of the endless belt according to the first exemplary embodiment and the endless belt according to the second exemplary embodiment is referred to as an "endless belt according to the present exemplary embodiment" and described. However, an example of the endless belt according to the present disclosure may be an endless belt that corresponds to at least one of the endless belt according to the first exemplary embodiment and the endless belt according to the second exemplary embodiment.

An endless belt according to the present exemplary embodiment will be described below with reference to the drawing.

The following description relates to an example of an endless belt that includes a metal substrate, a heat-resistant resin layer disposed on an inner peripheral surface of the metal substrate, an elastic layer disposed on an outer peripheral surface of the metal substrate, and a release layer disposed on an outer peripheral surface of the elastic layer.

FIG. 1 schematically illustrates an example of the layer structure of an endless belt according to the present exemplary embodiment. An endless belt 110 illustrated in FIG. 1 includes a metal substrate 120, a heat-resistant resin layer 130 disposed on an inner peripheral surface of the metal substrate 120, an elastic layer 140 disposed on an outer peripheral surface of the metal substrate 120, and a release layer 150 disposed on an outer peripheral surface of the elastic layer 140.

In FIG. 1, although the description has been made by way of an example of an endless belt that includes the metal substrate 120, the heat-resistant resin layer 130, the elastic layer 140, and the release layer 150, the endless belt according to the present exemplary embodiment is not limited to the structure described above. The endless belt according to the present exemplary embodiment is an endless belt that includes at least a metal substrate and a heat-resistant resin layer, in which the heat-resistant resin layer is an innermost layer. For example, the endless belt according to the present exemplary embodiment may be an endless belt that does not include a release layer or an endless belt that further includes another layer. An example of the other layer is an adhesive layer disposed, for example, between the metal substrate and the heat-resistant resin layer or between the metal substrate and the elastic layer.

Each layer constituting an endless belt according to the present exemplary embodiment will be specifically described below. It should be noted that reference numerals are omitted in the description below.

Metal Substrate

The metal substrate may be any endless substrate made of a metal material and is not particularly limited.

Examples of the metal material include metals such as SUS, nickel, copper, and aluminum. Of these, SUS and nickel (electroforming) are preferred in view of heat conduction and strength.

The thickness of the metal substrate is not particularly limited. From the viewpoints of having mechanical strength and ensuring flexibility, the thickness of the metal substrate is preferably 20 μm or more and 200 μm or less, more preferably 30 μm or more and 150 μm or less, still more preferably 40 μm or more and 130 μm or less, and particularly preferably 40 μm or more and 100 μm or less.

The thickness of the substrate may be uniform in the axial direction (that is, in the width direction of the endless belt) in view of mechanical strength.

Heat-Resistant Resin Layer

The heat-resistant resin layer is a layer that is disposed on an inner peripheral surface of the metal substrate and that contains a resin and a thermally conductive filler having an aspect ratio of 20 or more. The heat-resistant resin layer may optionally include other additives besides the resin and the thermally conductive filler having an aspect ratio of 20 or more.

The heat-resistant resin layer may be disposed on the inner peripheral surface of the metal substrate either directly or with another layer, such as an adhesive layer, interposed therebetween. From the viewpoint of obtaining a high thermal conductive property in the thickness direction of the endless belt, the heat-resistant resin layer may be disposed directly on the inner peripheral surface of the metal substrate. When the heat-resistant resin layer is disposed on the inner peripheral surface of the metal substrate with another layer interposed therebetween, the other layer may be a layer having a high thermal conductive property (for example, having a thermal conductivity of 20 W/mK or more at 150° C.)

The term "heat-resistant" as used herein means a property that a material is not melted or decomposed even if a temperature reaches a heating temperature (for example, 230° C., when narrow-width paper sheets are continuously passed, the temperature in a paper non-passing section rises considerably and may reach about 230° C. because heat is not removed by the paper sheets in the paper non-passing section) of a fixing device.

Resin

Examples of the resin contained in the heat-resistant resin layer include polyimide, polyamide-imide, polyamide, polyester, polyethylene terephthalate, polyethersulfone, polyetherketone, polyether ether ketone (PEEK), polysulfone, fluororesins, fluorinated polyimide, polybenzimidazole, polyphenylenesulfide, and polyetherimide. Of these, the resin contained in the heat-resistant resin layer is preferably a heat-resistant resin such as polyimide, polyamide-imide, or polyether ether ketone (PEEK) in view of heat resistance. The heat-resistant resin layer may contain one resin alone or two or more resins.

Polyimide and polyamide-imide will be described below as examples of the resin.

Polyamide-Imide

Polyamide-imide may be any resin having an imide bond and an amide bond in the repeating unit and is not particularly limited.

More specifically, polyamide-imide may be a polymer of a trivalent carboxylic acid compound (also referred to as a tricarboxylic acid) having an acid anhydride group and a diisocyanate compound or a diamine compound.

Examples of the tricarboxylic acid preferably include trimellitic anhydride and derivatives of trimellitic anhydride. A tetracarboxylic dianhydride, an aliphatic dicarboxylic acid, an aromatic dicarboxylic acid, or the like may be used in combination with the tricarboxylic acid.

Examples of the diisocyanate compound include 3,3'-dimethylbiphenyl-4,4'-diisocyanate, 2,2'-dimethylbiphenyl-4,4'-diisocyanate, biphenyl-4,4'-diisocyanate, biphenyl-3,3'-diisocyanate, biphenyl-3,4'-diisocyanate, 3,3'-diethylbiphenyl-4,4'-diisocyanate, 2,2'-diethylbiphenyl-4,4'-diisocyanate, 3,3'-dimethoxybiphenyl-4,4'-diisocyanate, 2,2'-dimethoxybiphenyl-4,4'-diisocyanate, naphthalene-1,5-diisocyanate, and naphthalene-2,6-diisocyanate.

Examples of the diamine compound include compounds that have a structure similar to that of any of the above isocyanates and that have amino groups instead of isocyanato groups.

Polyimide

Examples of polyimide include imidized products of polyamic acids (precursors of polyimide), which are polymers of tetracarboxylic dianhydrides and diamine compounds.

Specific examples of the tetracarboxylic dianhydride used as a raw material of polyimide include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl)ether dianhydride, and ethylenetetracarboxylic dianhydride.

Specific examples of the diamine compound used as a raw material of polyimide include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenyl sulfone, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenyl sulfone, 4,4'-diaminodiphenylpropane, 2,4-bis(β-amino-tert-butyl)toluene, bis(p-β-amino-tert-butylphenyl) ether, bis(p-β-methyl-δ-aminophenyl)benzene, bis-p-(1,1-dimethyl-5-amino-pentyl) benzene, 1-isopropyl-2,4-m-phenylenediamine, m-xylylenediamine, p-xylylenediamine, di(p-aminocyclohexyl) methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3(CH_2)_2O(CH_2)NH_2$, $H_2N(CH_2)_3S(CH_2)_3NH_2$, and $H_2N(CH_2)_3N(CH_3)_2(CH_2)_3NH_2$.

Thermally Conductive Filler

The thermally conductive filler contained in the heat-resistant resin layer may be any thermally conductive filler having an aspect ratio of 20 or more and is not particularly limited.

An example of the thermally conductive filler is a filler having a thermal conductivity of 20 W/mK or more at 150° C. Hereinafter, a thermal conductivity at 150° C. is also simply referred to as a "thermal conductivity".

Specific examples of the thermally conductive filler having an aspect ratio of 20 or more include carbon-based fillers such as carbon nanotubes and graphite. Of these, carbon nanotubes are preferred from the viewpoint of obtaining a high thermal conductive property of the endless belt. The carbon nanotubes may be single-walled carbon nanotubes or multi-walled carbon nanotubes. Thermally conductive fillers may be used alone or in combination of two or more thereof.

The aspect ratio of the thermally conductive filler is not particularly limited as long as the aspect ratio is 20 or more.

When the thermally conductive filler is fibrous, the term "aspect ratio of a thermally conductive filler" as used herein means a value determined by dividing the length of the thermally conductive filler by the major axis (width) of the thermally conductive filler.

The aspect ratio of the thermally conductive filler is preferably 20 or more, more preferably 25 or more, and still more preferably 35 or more from the viewpoint of obtaining the effect of orientation of the thermally conductive filler. The aspect ratio of the thermally conductive filler is preferably 100 or less, more preferably 80 or less, and still more preferably 60 or less in view of toughness.

When the thermally conductive filler is a carbon nanotube, the average outer diameter of carbon nanotubes is preferably 0.005 μm or more and 2 μm or less, more preferably 0.01 μm or more and 1.5 μm or less, still more preferably 0.02 μm or more and 1.0 μm or less, and particularly preferably 0.05 μm or more and 0.5 μm or less in view of dispersibility in the resin.

The average outer diameter of carbon nanotubes is preferably 10 times or more and 300 times or less, more preferably 20 times or more and 250 times or less, and still more preferably 30 times or more and 200 times or less the average thickness of the heat-resistant resin layer from the viewpoint of obtaining a high thermal conductive property on the inner peripheral surface of the endless belt while reducing the sliding resistance on the inner peripheral surface.

When the thermally conductive filler is a carbon nanotube, the average length of carbon nanotubes is preferably 0.5 μm or more and 100 μm or less, more preferably 1 μm or more and 60 μm or less, still more preferably 2 μm or more and 20 μm or less, and particularly preferably 3 μm or more and 10 μm or less in view of toughness of the layer containing the carbon nanotubes (CNT).

The aspect ratio of the thermally conductive filler and the average outer diameter and the average length of carbon nanotubes are arithmetical mean values determined from images obtained by observing, with an optical microscope, 100 or more thermally conductive filler particles to be measured. In the measurement of the aspect ratio and other values of the thermally conductive filler contained in the heat-resistant resin layer, the surface of the heat-resistant resin layer may be observed with an optical microscope, or the resin contained in the heat-resistant resin layer may be dissolved with a solvent and the remaining thermally conductive filler may be observed with an optical microscope.

The thermal conductivity of the thermally conductive filler is preferably 50 W/mK or more and more preferably 100 W/mK or more from the viewpoint of obtaining a high thermal conductive property on the inner peripheral surface of the endless belt. The upper limit of the thermal conductivity of the thermally conductive filler is not particularly limited. The thermal conductivity of the thermally conductive filler may be 3,000 W/mK or less.

The thermal conductivity of the thermally conductive filler is measured with, for example, a thermal conductivity analyzer (ai-Phase Mobile, manufactured by ai-Phase Co., Ltd.). In the measurement of the thermal conductivity of the thermally conductive filler contained in the heat-resistant resin layer, for example, the resin contained in the heat-resistant resin layer is dissolved with a solvent and the above measurement is performed for the remaining thermally conductive filler.

A thermal conductivity ratio (metal substrate/thermally conductive filler) of the metal substrate to the thermally conductive filler, that is, a ratio the thermal conductivity of the metal substrate to the thermal conductivity of the thermally conductive filler is preferably 1/100 or more and 1/3 or less, more preferably 1/80 or more and 1/4 or less, and still more preferably 1/60 or more and 1/6 or less from the viewpoint of obtaining a high thermal conductive property on the inner peripheral surface of the endless belt.

When the thermal conductivity ratio (metal substrate/thermally conductive filler) is within the above range, the thermally conductive filler has a thermal conductivity higher than that in the case where the thermal conductivity ratio is larger than the above range, and thus the thermal conductive property on the inner peripheral surface of the endless belt also tends to be high. When the thermal conductivity ratio (metal substrate/thermally conductive filler) is within the above range, slidability tends to be highly maintained compared with the case where the thermal conductivity ratio is smaller than the above range.

Note that the thermal conductivity of the metal substrate is also measured by the same method as that used in the measurement of the thermal conductivity of the thermally conductive filler.

The content of the thermally conductive filler in the heat-resistant resin layer is not particularly limited. From the viewpoint of obtaining a high thermal conductive property on the inner peripheral surface of the endless belt while reducing the sliding resistance on the inner peripheral surface, the content of the thermally conductive filler is preferably 5 parts by mass or more and 30 parts by mass or less, more preferably 8 parts by mass or more and 25 parts by mass or less, and still more preferably 10 parts by mass or more and 20 parts by mass or less relative to 100 parts by mass of the resin contained in the heat-resistant resin layer.

Orientation Ratio

The thermally conductive filler is contained in the heat-resistant resin layer such that the orientation ratio (circumferential direction) A is 20% or more.

Herein, the orientation ratio (circumferential direction) A is represented by the following formula.

$$A=(N'/N)\times 100 \quad \text{Formula:}$$

In the formula, N is the total number of thermally conductive filler particles, and N' is the number of thermally conductive filler particles whose tilt θ in a major axis direction with respect to the circumferential direction of the endless belt satisfies $-30°\leq\theta\leq 30°$.

When the thermally conductive filler is a carbon nanotube, the major axis direction of the thermally conductive filler means the length direction of the carbon nanotube.

The orientation ratio (circumferential direction) A is 20% or more. From the viewpoint of obtaining a high thermal conductive property on the inner peripheral surface of the endless belt while reducing the sliding resistance on the inner peripheral surface, the orientation ratio (circumferential direction) A is preferably 20% or more, more preferably 25% or more, still more preferably 30% or more, and particularly preferably 40% or more. The upper limit of the orientation ratio (circumferential direction) A is not particularly limited and may be 100%, may be 80% or less, may be 75% or less, and may be 70% or less.

From the viewpoint of obtaining a high thermal conductive property on the inner peripheral surface of the endless belt while reducing the sliding resistance on the inner peripheral surface, an orientation ratio of the thermally conductive filler with respect to the width direction of the endless belt is preferably 20% or more and 80% or less, more preferably 25% or more and 75% or less, and still more preferably 30% or more and 70% or less. Hereinafter, the orientation ratio of a thermally conductive filler with respect to the width direction of an endless belt is also referred to as an "orientation ratio (width direction) B".

When the orientation ratio (width direction) B is within the above range, slidability is higher than that in the case where the orientation ratio (width direction) B is larger than the above range, and strength in the axial direction is higher than that in the case where the orientation ratio (width direction) B is smaller than the above range.

The width direction of the endless belt means a rotational axis direction of the endless belt.

The orientation ratio (width direction) B is represented by the following formula.

$$B=(N''/N)\times 100 \quad \text{Formula:}$$

In the formula, N is the total number of thermally conductive filler particles, and N" is the number of thermally conductive filler particles whose tilt θ' in the major axis direction with respect to the width direction of the endless belt satisfies $-30°\leq\theta'\leq 30°$.

A ratio A/B of the orientation ratio (circumferential direction) A to the orientation ratio (width direction) B may be 1.0 or more.

When the ratio A/B is within the above range, a high thermal conductive property on the inner peripheral surface of the endless belt is obtained while the sliding resistance on the inner peripheral surface is reduced compared with the case where the ratio A/B is smaller than the above range.

The orientation ratio (circumferential direction) A and the orientation ratio (width direction) B are measured by the following method.

Specifically, the inner peripheral surface of the heat-resistant resin layer is observed with an optical microscope at 10 positions at equal intervals from one end to the other end of the heat-resistant resin layer in the width direction of the endless belt. For 50 or more thermally conductive filler particles, the total number N of thermally conductive filler particles, the number N' of thermally conductive filler particles whose tilt θ in the major axis direction with respect to the circumferential direction of the endless belt satisfies $-30°\leq\theta\leq 30°$, and the number N" of thermally conductive filler particles whose tilt θ' in the major axis direction with respect to the width direction of the endless belt satisfies $-30° \leq \theta' \leq 30°$ are counted to calculate the orientation ratio (circumferential direction) A and the orientation ratio (width direction) B.

An example of the method for controlling the orientation ratio (circumferential direction) A and the orientation ratio (width direction) B is a method in which a heat-resistant resin layer is formed by a spiral coating method and coating conditions are adjusted. In the spiral coating method, for example, a heat-resistant resin layer-forming coating liquid is discharged onto an inner peripheral surface of a metal substrate while rotating the metal substrate and moving a discharge unit that discharges the heat-resistant resin layer-forming coating liquid onto the inner peripheral surface of the metal substrate from one end to the other end of the metal substrate in the rotational axis direction (that is, in the width direction of the endless belt). The orientation ratio (circumferential direction) A and the orientation ratio (width direction) B are controlled by adjusting the rotational speed of the metal substrate, the travelling speed of the discharge unit in the rotational axis direction of the metal substrate, and the amount of heat-resistant resin layer-forming coating liquid discharged per unit time.

Method for Forming Heat-Resistant Resin Layer

An example of the method for forming the heat-resistant resin layer includes a coating liquid preparation step of preparing a heat-resistant resin layer-forming coating liquid that provides a heat-resistant resin layer by heating, an application step of applying the heat-resistant resin layer-forming coating liquid to an inner peripheral surface of a metal substrate to form a coating film, and a heating step of heating the coating film.

The heating step may include, for example, plural steps of conducting heating at different temperatures. Specifically, for example, the heating step may include a drying step of drying the coating film (that is, removing a solvent in the coating film), and a baking step of conducting baking by heating the dried coating film at a temperature higher than that in the drying step.

Coating Liquid Preparation Step

In the coating liquid preparation step, a heat-resistant resin layer-forming coating liquid that provides a heat-resistant resin layer by heating is prepared.

An example of the heat-resistant resin layer-forming coating liquid contains a solvent, at least one of a resin precursor and a resin, a thermally conductive filler, and optionally other additives.

The solvent is appropriately selected depending on, for example, the type of at least one of a resin precursor and a resin used. Specifically, for example, the solvent may be an organic polar solvent.

Specifically, examples of the organic polar solvent include sulfoxide solvents such as dimethyl sulfoxide and diethyl sulfoxide; formamide solvents such as N,N-dimethylformamide and N,N-diethylformamide; acetamide solvents such as N,N-dimethylacetamide and N,N-diethylacetamide; pyrrolidone solvents such as N-methyl-2-pyrrolidone and N-vinyl-2-pyrrolidone; phenol solvents such as phenol, o-cresol, m-cresol, p-cresol, xylenol, halogenated phenols, and catechol; ether solvents such as tetrahydrofuran, dioxane, and dioxolane; alcohol solvents such as methanol, ethanol, and butanol; cellosolves such as butyl cellosolve; hexamethylphosphoramide; and γ-butyrolactone.

One solvent may be used alone or two or more solvents may be used in combination.

The content of the solvent in the heat-resistant resin layer-forming coating liquid may be in the range of 70% by mass or more and 80% by mass or less and is desirably 76% by mass or more and 78% by mass or less relative to the total amount of the heat-resistant resin layer-forming coating liquid.

A viscosity of the heat-resistant resin layer-forming coating liquid (viscosity at 25° C.) is not particularly limited, but may be, for example, in the range of 1 Pa·s or more and 100 Pa·s or less and is desirably in the range of 3 Pa·s or more and 50 Pa·s or less.

The viscosity of the coating liquid is measured in an environment at 25° C. with a constant-speed viscometer PK100 manufactured by HAAKE Inc.

The heat-resistant resin layer-forming coating liquid may be prepared, for example, by dispersing a thermally conductive filler in a solvent to prepare a dispersion liquid and dissolving at least one of a resin precursor and a resin in the dispersion liquid, or by dissolving at least one of a resin precursor and a resin in a solvent to prepare a solution and dispersing a thermally conductive filler in the solution.

Examples of the method for dispersing a thermally conductive filler include publicly known methods such as methods using a ball mill, a sand mill, a bead mill, or a jet mill (counter collision-type disperser).

Application Step

In the application step, the heat-resistant resin layer-forming coating liquid is applied to an inner peripheral surface of a metal substrate to form a coating film. An example of the method for forming a coating film on an inner peripheral surface of a metal substrate is a spiral coating method.

In the spiral coating method, specifically, while a metal substrate is rotated around the axis with the rotational axis direction of the metal substrate being a direction along a horizontal direction, a heat-resistant resin layer-forming coating liquid is discharged from a discharge unit to apply the coating liquid to the inner peripheral surface of the metal substrate. During the rotation of the metal substrate, the heat-resistant resin layer-forming coating liquid is discharged from the discharge unit while the discharge unit is moved from one end to the other end of the metal substrate in the rotational axis direction. Consequently, the heat-resistant resin layer-forming coating liquid is applied to the inner peripheral surface of the metal substrate in a spiral manner, and a coating film is formed.

Heating Step

In the heating step, the coating film formed in the application step is heated to remove the solvent in the coating film, thus forming a heat-resistant resin layer. In the heating step, the coating film on the inner peripheral surface of the metal substrate is heated by, for example, sending a gas at a high temperature (a temperature higher than a heating temperature) from one end toward the other end of the metal substrate in the rotational axis direction.

As described above, the heating step may include, for example, a drying step of drying the coating film and a baking step of conducting baking by heating the dried coating film. The heating temperature in the drying step is, for example, 120° C. or higher and 220° C. or lower and is preferably 140° C. or higher and 210° C. or lower. The heating temperature in the baking step is, for example, a temperature higher than the heating temperature in the drying step and is preferably 200° C. or higher and 300° C. or lower and more preferably 240° C. or higher and 280° C. or lower.

Thickness and Properties

An average thickness of the heat-resistant resin layer is preferably 1 μm or more and 40 μm or less, more preferably 3 μm or more and 30 μm or less, and still more preferably 5 μm or more and 20 μm or less from the viewpoint of obtaining a high thermal conductive property on the inner peripheral surface of the endless belt while reducing the sliding resistance on the inner peripheral surface.

The average thickness of the heat-resistant resin layer is an average of values measured at five points at equal intervals from one end to the other end of the heat-resistant resin layer in the width direction of the endless belt. The thickness of the heat-resistant resin layer is measured with, for example, a micrometer.

The average thickness of the heat-resistant resin layer is preferably 0.01 times or more and 1 time or less, more preferably 0.05 times or more and 0.8 times or less, and still more preferably 0.1 times or more and 0.4 times or less the thickness of the metal substrate from the viewpoint of obtaining a high thermal conductive property on the inner peripheral surface of the endless belt while reducing the sliding resistance on the inner peripheral surface.

The thickness of the heat-resistant resin layer may be gradually increased from a central portion toward an end in the width direction of the endless belt. When the thickness of the heat-resistant resin layer is increased toward an end, a shift of the endless belt in the width direction is reduced during rotation of the endless belt, meandering of the endless belt in unlikely to occur, and thus generation of a crease of a recording medium may be reduced.

From the viewpoint of reducing the shift of the endless belt in the width direction, the thickness of the heat-resistant resin layer at an end in the width direction of the endless belt is preferably 1 time or more and 3 times or less, and more preferably 1 time or more and 2.5 times or less the thickness of the heat-resistant resin layer at the central portion in the width direction of the endless belt. Note that if the thickness of the elastic layer is gradually increased from the central portion toward an end in the width direction of the endless belt, the thickness of the heat-resistant resin layer is not necessarily increased from the central portion toward the end in the width direction of the endless belt.

An example of the method for gradually increasing the thickness of the heat-resistant resin layer from the central portion toward an end in the width direction of the endless belt is a method in which a heat-resistant resin layer is formed by the spiral coating method and coating conditions are adjusted. Specifically, examples of the method include a method in which the travelling speed of the discharge unit in the rotational axis direction of the metal substrate is changed from the central portion toward an end in the width direction of the endless belt, and a method in which the amount of heat-resistant resin layer-forming coating liquid discharged per unit time is changed from the central portion toward an end in the width direction of the endless belt.

An arithmetical mean roughness Ra of the inner peripheral surface of the heat-resistant resin layer in the width direction of the endless belt is 0.01 μm or more and 1.20 μm or less. From the viewpoint of reducing the sliding resistance on the inner peripheral surface of the endless belt, the arithmetical mean roughness Ra is preferably 0.05 μm or more and 1.05 μm or less, and more preferably 0.1 μm or more and 0.9 μm or less.

A mean spacing Sm of irregularities on the inner peripheral surface of the heat-resistant resin layer in the width direction of the endless belt is 10 μm or more and 500 μm or less. From the viewpoint of reducing the sliding resistance on the inner peripheral surface of the endless belt, the mean spacing Sm is preferably 20 μm or more and 450 μm or less, and more preferably 30 μm or more and 400 μm or less.

Herein, the arithmetical mean roughness Ra and the mean spacing Sm of irregularities are based on JIS B0601 (1994) standard. The arithmetical mean roughness Ra and the mean spacing Sm of irregularities are measured with a SURFCOM device manufactured by Tokyo Seimitsu Co., Ltd. under the following conditions: measuring length: 4 mm, cut-off wavelength: 0.8 mm, cut-off type: Gaussian, and measuring speed: 0.3 mm/s.

An example of the method of adjusting the arithmetical mean roughness Ra and the mean spacing Sm of irregularities on the inner peripheral surface of the heat-resistant resin layer in the width direction of the endless belt to the above ranges is a method of adjusting the orientation ratio (circumferential direction) A of the thermally conductive filler contained in the heat-resistant resin layer to 20% or more.

The thermal conductivity of the whole of the heat-resistant resin layer is preferably 0.6 W/mK or more and more preferably 0.8 W/mK or more. The upper limit of the thermal conductivity of the whole of the heat-resistant resin layer is not particularly limited. The thermal conductivity on the inner peripheral surface of the heat-resistant resin layer may be 2.5 W/mK or less.

The thermal conductivity of the whole of the heat-resistant resin layer is also measured by the same method as that used in the measurement of the thermal conductivity of the thermally conductive filler. However, the thermal conductivity of the whole of the heat-resistant resin layer is an average of values measured at ten points at equal intervals from one end to the other end of the heat-resistant resin layer in the width direction of the endless belt.

Elastic Layer

The elastic layer is a layer that is optionally provided on the outer peripheral surface of the metal substrate, and is not particularly limited as long as the layer has elasticity. When the endless belt is used as a fixing belt of a fixing device, the elastic layer is provided from the viewpoint of providing elasticity to a pressure applied to the fixing belt from the outer peripheral side and, for example, has a role of conforming to irregularities of a toner image on a recording medium, so that the surface of the fixing belt comes in close contact with the toner image.

The elastic layer may be composed of an elastic material that returns to its original shape even after being deformed by applying an external force of, for example, 100 Pa.

Examples of the elastic material used in the elastic layer include fluororesins, silicone resins, silicone rubbers, fluororubbers, and fluorosilicone rubbers. The material of the elastic layer is preferably a silicone rubber or a fluororubber and more preferably a silicone rubber in view of, for example, heat resistance, a thermal conductive property, and an insulating property.

Examples of the silicone rubbers include room-temperature vulcanizing (RTV) silicone rubber, high-temperature vulcanizing (HTV) silicone rubber, and liquid silicone rubber. Specific examples thereof include polydimethyl silicone rubber (MQ), methylvinyl silicone rubber (VMQ), methylphenyl silicone rubber (PMQ), and fluorosilicone rubber (FVMQ).

An example of a commercially available silicone rubber is SE6744 liquid silicone rubber manufactured by Dow Corning Corporation.

The silicone rubbers may be silicone rubbers whose crosslinking form includes an addition reaction crosslinking form. Known silicone rubbers have various types of functional groups. For example, dimethyl silicone rubber having methyl groups, methylphenyl silicone rubber having a methyl group and a phenyl group, and vinyl silicone rubber having a vinyl group (vinyl group-containing silicone rubber) are preferred. Vinyl silicone rubber having a vinyl group is more preferred, and furthermore, a silicone rubber that has an organopolysiloxane structure having a vinyl group and a hydrogen organopolysiloxane structure having a hydrogen atom (SiH) bound to a silicon atom is preferred.

Examples of the fluororubbers include vinylidene fluoride rubbers, tetrafluoroethylene/propylene rubbers, tetrafluoroethylene/perfluoromethyl vinyl ether rubber, phosphazene rubbers, and fluoropolyethers.

An example of commercially available fluororubber is Viton B-202 manufactured by DuPont Dow Elastomers LLC.

The elastic material used in the elastic layer preferably contains, as a main component, (that is, contains in an amount of 50% or more in terms of mass ratio) silicone rubber. Furthermore, the content thereof is more preferably 90% by mass or more and still more preferably 99% by mass or more.

The elastic layer may contain, in addition to the elastic material, an inorganic filling agent for the purpose of, for example, reinforcement, heat resistance, and heat transfer. Examples of the inorganic filling agent include publicly known inorganic filling agents. Preferred examples thereof include fumed silica, crystalline silica, iron oxide, alumina, and metallic silicon.

Examples of the material of the inorganic filling agent include, in addition to the above, well known inorganic fillers such as carbides (carbon black, carbon fibers, and carbon nanotubes), titanium oxide, silicon carbide, talc, mica, kaolin, calcium carbonate, calcium silicate, magnesium oxide, graphite, silicon nitride, boron nitride, cerium oxide, and magnesium carbonate.

Of these, silicon nitride, silicon carbide, graphite, boron nitride, and carbides are preferred in view of thermal conductive properties.

The content of the inorganic filling agent in the elastic layer may be determined depending on, for example, thermal conductive properties and mechanical strength desired, and is, for example, 1% by mass or more and 20% by mass or less, preferably 3% by mass or more and 15% by mass or less, and more preferably 5% by mass or more and 10% by mass or less relative to the total of the elastic layer.

The elastic layer may contain additives. Examples of the additives include softening agents (such as paraffin agents), processing aids (such as stearic acid), age resisters (such as amines), vulcanizing agents (such as sulfur, metal oxides, and peroxides), and functional filling agents (such as alumina).

The thickness of the elastic layer may be, for example, in the range of 30 μm or more and 600 μm or less and is preferably in the range of 100 μm or more and 500 μm or less.

Note that the thickness of the elastic layer may be uniform from a central portion toward an end in the width direction of the endless belt or may be gradually increased from a central portion toward an end.

A publicly known method may be used to form the elastic layer. For example, the elastic layer may be formed on the outer peripheral surface of a metal substrate by a coating method.

When a silicone rubber is used as the elastic material of the elastic layer, for example, first, an elastic layer-forming coating liquid containing a liquid silicone rubber that is cured by heating to provide a silicone rubber is prepared. Next, the elastic layer-forming coating liquid is applied (for example, applied by a flow coating method (spiral coating method)) onto a metal substrate to form an elastic coating film, and, for example, the elastic coating film is vulcanized as required. As a result, an elastic layer is formed on the metal substrate. The vulcanizing temperature in vulcanization is, for example, 150° C. or higher and 250° C. or lower, and the vulcanizing time is, for example, 30 minutes or more and 120 minutes or less.

Release Layer

The release layer is a layer that is optionally provided on the outer peripheral surface of the elastic layer. When the endless belt is used as a fixing belt of a fixing device, the release layer has a role of reducing, during fixing, adhesion of a molten toner image onto a surface (outer peripheral surface) that comes in contact with a recording medium.

The release layer is desired to have, for example, heat resistance and releasability. In view of this, a heat-resistant releasing material may be used as the material constituting the release layer. Specifically, examples of the material include fluororubbers, fluororesins, silicone resins, and polyimide resins.

Of these, fluororesins may be used as the heat-resistant releasing material.

Specific examples of the fluororesins include tetrafluoroethylene-perfluoroalkyl vinyl ether copolymers (PFA), polytetrafluoroethylene (PTFE), tetrafluoroethylene-hexafluoropropylene copolymers (FEP), polyethylene-tetrafluoroethylene copolymers (ETFE), polyvinylidene fluoride (PVDF), polychlorotrifluoroethylene (PCTFE), and vinyl fluoride (PVF).

A surface of the release layer, the surface being adjacent to the elastic layer, may be subjected to surface treatment. The surface treatment may be wet treatment or dry treatment. Examples of the surface treatment include liquid ammonia treatment, excimer laser treatment, and plasma treatment.

The thickness of the release layer may be in the range of 10 μm or more and 100 μm or less and is more preferably in the range of 15 μm or more and 50 μm or less.

A publicly known method may be employed to form the release layer. The release layer may be formed by, for example, a coating method.

Alternatively, the release layer may be formed by preparing a tubular release layer in advance, and covering the outer periphery of the elastic layer with the tubular release layer.

Fixing Device

A fixing device according to the present exemplary embodiment includes a first rotatable body formed of an endless belt according to the present exemplary embodiment described above, a second rotatable body disposed in contact with an outer peripheral surface of the first rotatable body, and a pressing member that is disposed inside the first rotatable body and that presses the first rotatable body from an inner peripheral surface of the first rotatable body against the second rotatable body.

The fixing device according to the present exemplary embodiment may further include a heating source disposed inside the first rotatable body.

Examples of the fixing device according to the present exemplary embodiment will now be described with reference to the drawings but are not limited thereto.

First Fixing Device

Figure 2:
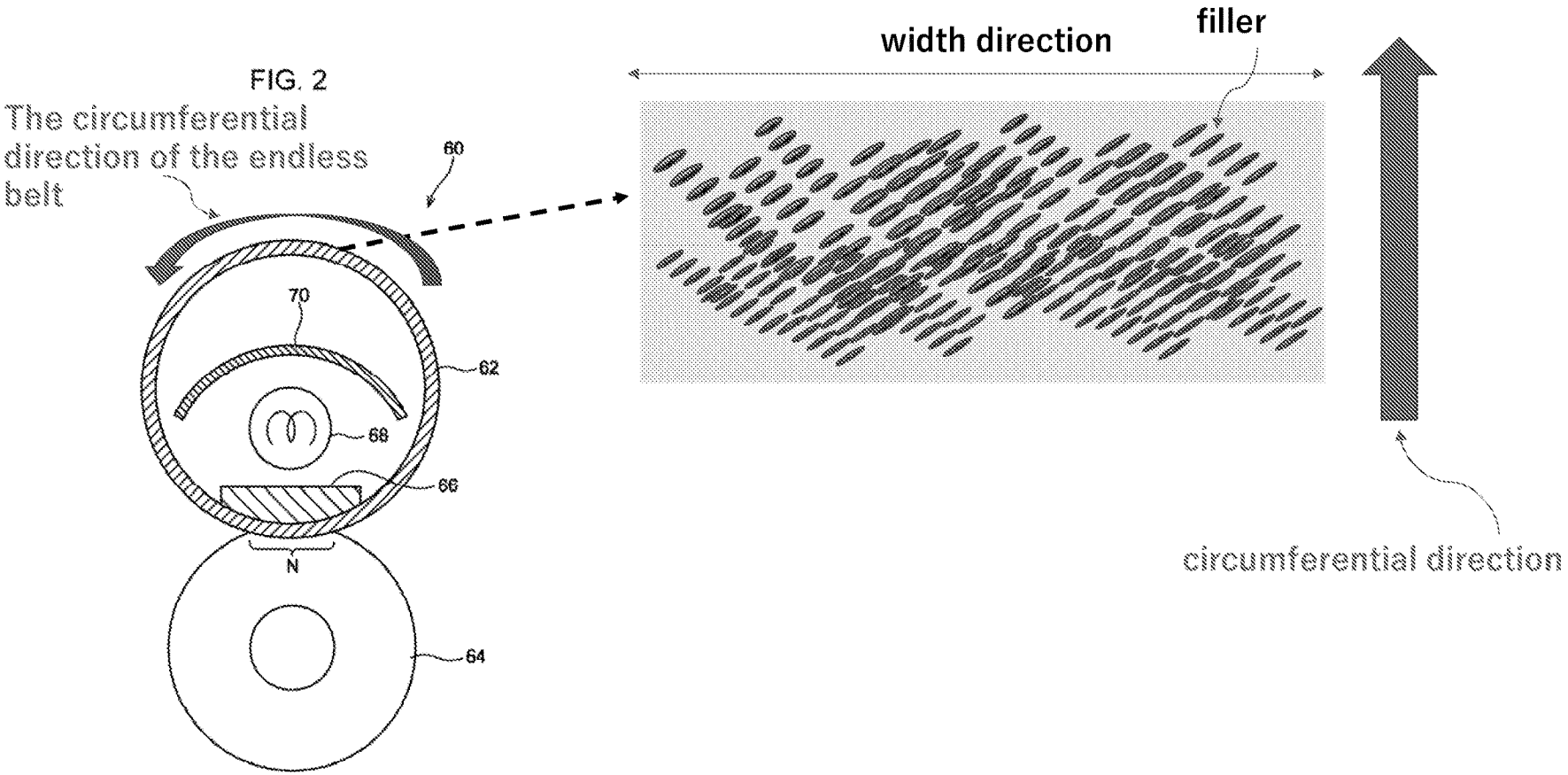
FIG. 2 is a schematic view of a first fixing device which is an example of the structure of a fixing device according to the exemplary embodiment.

FIG. 2 is a schematic view illustrating an example of a first fixing device.

A fixing device 60 illustrated in FIG. 2 includes a fixing belt 62 (an example of the first rotatable body) formed of an endless belt according to the present exemplary embodiment described above, a pressurizing roller 64 (an example of the second rotatable body), a pressurizing pad 66 (an example of the pressing member), a halogen lamp 68 (an example of the heating source), and a reflective plate 70.

The outer peripheral surfaces of the fixing belt 62 and the pressurizing roller 64 are in contact with each other to form a contact region N. The fixing belt 62 and the pressurizing roller 64 rotate together with each other to transport a recording medium in the contact region N.

The fixing belt 62 is rotatably supported by unillustrated bearings at both ends of the fixing belt 62 in the axial direction. An unillustrated drive transmitting member (such as a gear) is fitted into one of the ends of the fixing belt 62 in the axial direction. The fixing belt 62 is configured to rotate with the drive transmitting member being rotated around the axis by an unillustrated driving source (such as a motor).

The pressurizing roller 64 is disposed in contact with the outer peripheral surface of the fixing belt 62.

As one example, the pressurizing roller 64 is composed of a resin or a metal and is formed to have a cylindrical or columnar shape. In a part of the outer peripheral surface of the pressurizing roller 64, an unillustrated bearing member is pressed by an elastic member (such as a spring) against the pressurizing pad 66 with the fixing belt 62 interposed between the pressurizing roller 64 and the pressurizing pad 66. As a result, the pressurizing roller 64 and the fixing belt 62 form a contact region N (so-called nip part). That is, the pressurizing roller 64 has a function of sandwiching and pressurizing the fixing belt 62 in the contact region N together with the pressurizing pad 66.

Unillustrated fitting members (such as caps) are fitted into both ends of the pressurizing roller 64 in the axial direction to enhance the rigidity of the pressurizing roller 64 against an external force applied in the radial direction of the pressurizing roller 64. The fitting members are supported by unillustrated bearing members so as to be rotatable around the axis. The pressurizing roller 64 is configured to be passively rotated with the fixing belt 62 being rotated. As a result, the pressurizing roller 64 rotates together with the fixing belt 62 in the contact region N to transport a recording medium.

Alternatively, the fixing belt 62 may be passively rotated by rotational driving of the pressurizing roller 64.

The pressurizing pad 66 is disposed on the inner peripheral surface of the fixing belt 62.

As one example, the pressurizing pad 66 is a pillar-shaped member composed of a resin or a metal.

The pressurizing pad 66 has a function of sandwiching and pressurizing the fixing belt 62 in the contact region N together with the pressurizing roller 64, as a result of the pressurizing roller 64 being pressed against the pressurizing pad 66 with the fixing belt 62 interposed therebetween.

Alternatively, the pressurizing pad 66 may be pressed by an elastic member (such as a spring) against the pressurizing roller 64 with the fixing belt 62 interposed therebetween. That is, the pressurizing pad 66 may be either a member that pressurizes the fixing belt 62 as a result of being pressed by the pressurizing roller 64 or a member that pressurizes the fixing belt 62 as a result of pressing the pressurizing roller 64.

Alternatively, a roller-like pressurizing member may be used instead of the pressurizing pad 66.

The halogen lamp 68 is disposed above the inner peripheral surface of the fixing belt 62. Specifically, for example, the halogen lamp 68 is arranged to face the contact region N with the pressurizing pad 66 interposed therebetween. The halogen lamp 68 directly heats the contact region N.

The halogen lamp 68 is formed of a hollow-cylindrical halogen lamp extending in the width direction of the fixing belt 62 (the rotational axis direction of the belt). Since the halogen lamp 68 includes, as a heat source, a filament having a low heat capacity, the halogen lamp 68 starts radiating heat immediately after the power supply is turned on.

A publicly known heating source such as a ceramic heater or a quartz lamp may be provided instead of the halogen lamp 68.

The reflective plate 70 is disposed above the inner peripheral surface of the fixing belt 62. Specifically, for example, the reflective plate 70 is arranged to face the contact region N with the halogen lamp 68 interposed therebetween.

As one example, the reflective plate 70 is a plate-like metal member or a plate-like resin member that includes a metal layer formed on the reflecting surface by vapor deposition. The reflection plate 70 is, for example, curved such that the contact region N side thereof is concave.

The reflective plate 70 has a function of reflecting heat radiated from the halogen lamp 68 toward the contact region N.

In the fixing device 60 described above, the fixing belt 62 and the pressurizing roller 64 rotate, and a toner image formed on a recording medium is pressurized and heated in the contact region N between the fixing belt 62 and the pressurizing roller 64. As a result, the toner image is fixed to the recording medium.

Since the fixing belt 62 is the endless belt according to the present exemplary embodiment described above, the fixing belt 62 has a high thermal conductivity, and the sliding resistance between the inner peripheral surface of the fixing belt 62 and the sliding surface of the pressurizing pad 66 is reduced. Therefore, the warm-up time of the fixing device 60 is short, and a partial temperature increase caused when an image is continuously fixed to a small-size medium is reduced. Furthermore, for example, an increase in the rotational load due to the sliding resistance between the fixing belt 62 and the pressurizing pad 66, meandering of the fixing belt 62, and generation of an unusual sound are suppressed.

Since the fixing belt 62 has a low heat capacity, and the halogen lamp 68 directly heats the contact region N, a region of the fixing belt 62 other than the contact region N is easily cooled. Therefore, the occurrence of hot offset due to overshoot is easily reduced.

Since the halogen lamp 68 includes, as a heat source, a filament having a low heat capacity, the halogen lamp 68 is a heating source that starts radiating heat immediately after the power supply is turned on. Accordingly, use of the halogen lamp 68 enables the time in the power-off state to be prolonged, and thus easily reduces the occurrence of hot offset due to overshoot.

Use of the reflective plate 70 enables the contact region N to be rapidly heated. That is, since the time in the power-off state of the halogen lamp 68 is prolonged, the occurrence of hot offset due to overshoot is easily reduced.

Second Fixing Device

Figure 3:
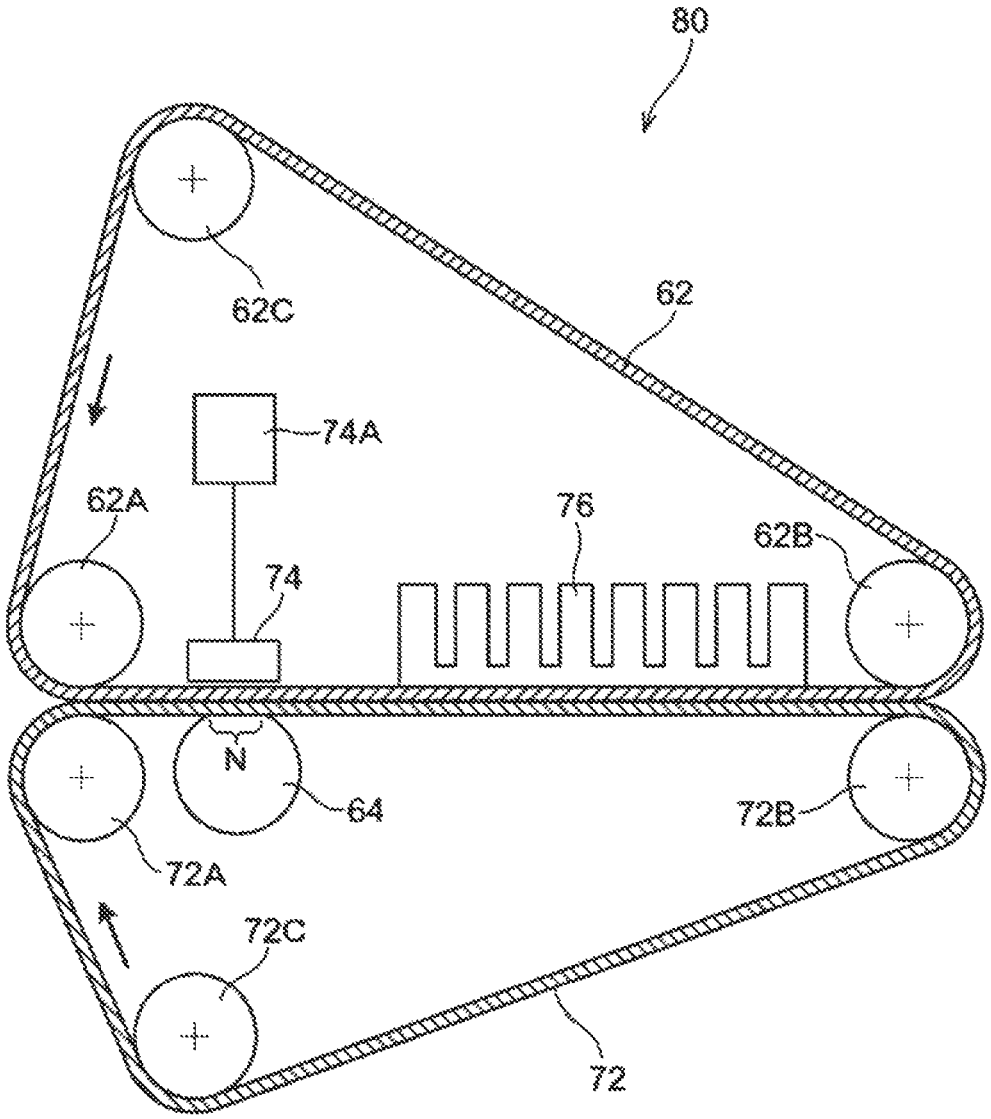
FIG. 3 is a schematic view of a second fixing device which is another example of the structure of a fixing device according to the exemplary embodiment.

FIG. 3 is a schematic view illustrating an example of a second fixing device. Members having substantially the same function as the members of the first fixing device are assigned the same reference numerals, and the description thereof is omitted.

A fixing device 80 illustrated in FIG. 3 includes a fixing belt 62 (an example of the first rotatable body) formed of an endless belt according to the present exemplary embodiment described above, a pressurizing roller 64 (an example of the second rotatable body), a recording medium transporting belt 72, a linear heating element 74 (an example of the pressing member and the heating source), a pulse energizing unit 74A, and a heat sink 76.

The outer peripheral surfaces of the fixing belt 62 and the pressurizing roller 64 are in contact with each other with the recording medium transporting belt 72 interposed therebetween to form a contact region N. The fixing belt 62 and the pressurizing roller 64 are rotated together with each other to transport a recording medium in the contact region N.

Note that the contact region N in which the outer peripheral surfaces of the fixing belt 62 and the pressurizing roller 64 are in contact with each other includes a contact region N in which the outer peripheral surfaces of the fixing belt 62 and the pressurizing roller 64 come into contact with each other with another member, such as the recording medium transporting belt 72, interposed therebetween.

The fixing belt 62 is supported while being tightly stretched by rotational supporting rollers 62A, 62B, and 62C. Among the three rotational supporting rollers 62A, 62B, and 62C, the rotational supporting roller 62B, which is the first one disposed downstream of the position of the linear heating element 74 in the rotation direction of the fixing belt 62, functions as a driving roller that rotationally drives the fixing belt 62.

The pressurizing roller 64 is disposed on the inner peripheral surface of the recording medium transporting belt 72. In a part of the outer peripheral surface of the pressurizing roller 64, an unillustrated bearing member is pressed by an elastic member (such as a spring) against the linear heating element 74 with the fixing belt 62 and the recording medium transporting belt 72 that are interposed between the pressurizing roller 64 and the linear heating element 74. Accordingly, the pressurizing roller 64 and the fixing belt 62 form a contact region N (so-called nip part) with the recording medium transporting belt 72 interposed therebetween. That is, the pressurizing roller 64 has a function of sandwiching and pressurizing the fixing belt 62 and the recording medium transporting belt 72 in the contact region N together with the linear heating element 74.

The recording medium transporting belt 72 is supported while being tightly stretched by rotational supporting rollers 72A, 72B, and 72C. The recording medium transporting belt 72 is passively rotated with the fixing belt 62 being rotated.

The rotational supporting rollers 62A and 62B that support the fixing belt 62 are arranged to face the rotational supporting rollers 72A and 72B that support the recording medium transporting belt 72, respectively, with the fixing belt 62 and the recording medium transporting belt 72 interposed therebetween. That is, the outer peripheral surfaces of the fixing belt 62 and the recording medium transporting belt 72 are arranged so as to face each other between the rotational supporting rollers 62A and 72A and the rotational supporting rollers 62B and 72B.

The linear heating element 74 is disposed on the inner peripheral surface of the fixing belt 62. Specifically, the linear heating element 74 is arranged to face the contact region N. The linear heating element 74 directly heats the contact region N.

The linear heating element 74 also has a function of sandwiching and pressurizing the fixing belt 62 in the contact region N together with the pressurizing roller 64 as a result of the pressurizing roller 64 being pressed against the linear heating element 74 with the fixing belt 62 and the recording medium transporting belt 72 interposed therebetween.

The linear heating element 74 is formed of a long member extending in the width direction of the fixing belt 62 (the rotational axis direction of the endless belt). The linear heating element 74 is, for example, a heating source that includes a substrate and a linear heat-generating portion disposed on the substrate. The linear heat-generating portion includes plural heat-generating resistors arranged in a line, the heat-generating resistors serving as heat sources. That is, the linear heating element 74 is a heating element distinguished from heating elements composed of a nichrome wire. An example of the linear heating element 74 is a thermal head.

The pulse energizing unit 74A includes a power supply and is electrically connected to the linear heating element 74 in order to apply a pulse current to the linear heating element 74. Specifically, the pulse energizing unit 74A applies a pulse current to the heat-generating resistors.

Examples of the shape of the pulse current applied by the pulse energizing unit 74A include rectangular waves, triangular waves, and sine waves. The pulse energizing unit 74A need not be turned to the off state during intervals between pulses.

The pulse energizing unit 74A is connected to a controller 40. The controller 40 controls the pulse energizing unit 74A and causes the pulse energizing unit 74A to apply a pulse current to the linear heating element 74.

The heat sink 76 is disposed in contact with the inner peripheral surface of the fixing belt 62. Specifically, for example, the heat sink 76 is disposed downstream of the contact region N in the rotation direction of the fixing belt 62.

The heat sink 76 absorbs and dissipates heat of the fixing belt 62 to cool the fixing belt 62, at the position downstream of the contact region N to be heated, in the rotation direction of the fixing belt 62. Thus, a fixed image obtained after fixing of the toner image in the contact region N is cooled.

In the fixing device 80 described above, the recording medium on which the toner image is formed is pressurized and heated in the contact region N where the fixing belt 62 and the pressurizing roller 64 are in contact with each other with the recording medium transporting belt 72 interposed therebetween. As a result, the toner image is fixed to the recording medium. Subsequently, the fixed image on the recording medium is cooled by the heat sink 76 and then separated from the fixing belt 62.

Since the fixing belt 62 is the endless belt according to the present exemplary embodiment described above, the fixing belt 62 has a high thermal conductivity, and the sliding resistance between the inner peripheral surface of the fixing belt 62 and the sliding surface of the linear heating element 74 is reduced. Therefore, the warm-up time of the fixing device 60 is short, and a partial temperature increase caused when an image is continuously fixed to a small-size medium is reduced. Furthermore, for example, an increase in the rotational load due to the sliding resistance between the fixing belt 62 and the linear heating element 74, meandering of the fixing belt 62, and generation of an unusual sound are suppressed.

Since the linear heating element 74 directly heats the contact region N, a region of the fixing belt 62 other than the contact region N is easily cooled. Therefore, the occurrence of hot offset due to overshoot is easily reduced.

In the linear heating element 74, since a heat-generating region may be divided into a large number of regions as in a thermal head or the like, the amount of heat generated by the linear heating element 74 is easily controlled. Therefore, the occurrence of hot offset due to overshoot is easily reduced.

The linear heating element 74 generates heat in accordance with the pulse energizing unit 74A, and the temperature of the linear heating element 74 is easily controlled by adjusting, for example, the pulse waveform and the pulse intervals of pulse energization. Therefore, the occurrence of hot offset due to overshoot is easily reduced.

After the image fixed in the contact region N is cooled by the heat sink 76 (that is, after the molten toner forming the image is solidified), the fixed image is separated from the fixing belt 62. Therefore, the occurrence of hot offset is easily reduced. In addition to this, since the fixing belt 62 is also cooled by the heat sink 76, the occurrence of hot offset due to overshoot is easily reduced.

The heat sink 76 may be omitted. Alternatively, the diameter of the rotational supporting roller 72B, which is disposed at a position at which the fixed image is separated from the fixing belt 62 and which supports the recording medium transporting belt 72, may be increased, and the rotational supporting roller 72B having a large diameter may function as a cooling unit. When the diameter of the rotational supporting roller 72B is increased (specifically, for example, when the diameter of the rotational supporting roller 72B is made larger than the diameter of the rotational supporting roller 62B that supports the fixing belt 62), the fixed image is cooled by the rotational supporting roller 72B with the recording medium transporting belt 72 interposed therebetween.

Image Forming Apparatus

An image forming apparatus according to the present exemplary embodiment includes an image carrier, a charging device that charges a surface of the image carrier, a latent image forming device that forms a latent image on the charged surface of the image carrier; a developing device that develops the latent image with toner to form a toner image, a transfer device that transfers the toner image to a recording medium, and the above-described fixing device according to the present exemplary embodiment, in which the fixing device fixes the toner image to the recording medium. The image forming apparatus according to the present exemplary embodiment includes, as the fixing device, the above-described first fixing device.

An example of the image forming apparatus according to the exemplary embodiment will be described below with reference to the attached drawing. The image forming apparatus is not limited to this.

Figure 4:
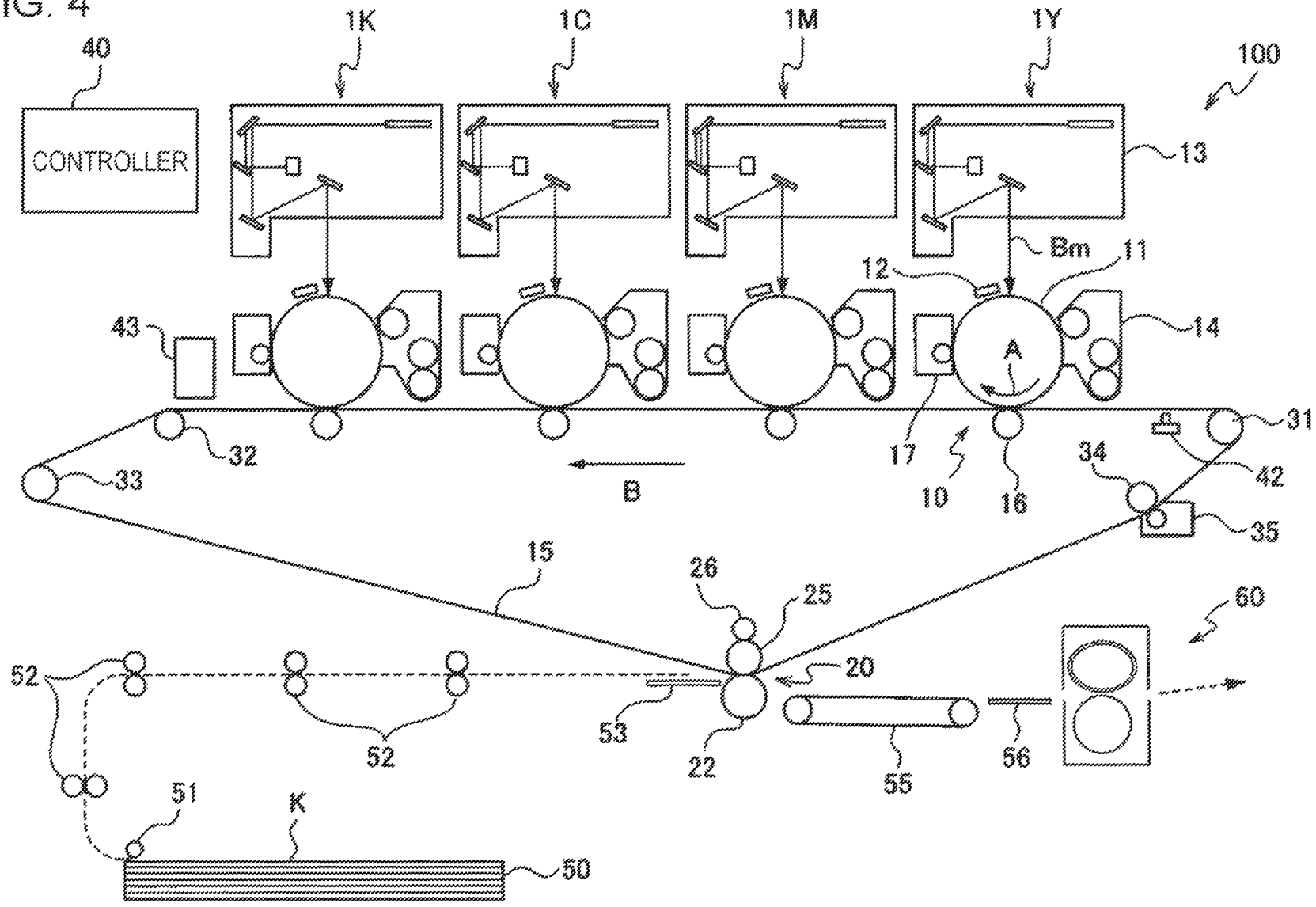
FIG. 4 is a schematic view illustrating an example of the structure of an image forming apparatus according to the exemplary embodiment.

FIG. 4 is a schematic view illustrating an example of the structure of an image forming apparatus according to the exemplary embodiment.

An image forming apparatus 100 illustrated in FIG. 4 is, for example, an intermediate-transfer image forming apparatus, which is commonly referred to as a tandem image forming apparatus. The image forming apparatus 100 includes plural image forming units 1Y, 1M, 1C, and 1K that form toner images of respective color components by an electrophotographic system; first transfer sections 10 that sequentially transfer (first-transfers) the toner images of respective color components formed by the image forming units 1Y, 1M, 1C, and 1K to an intermediate transfer belt 15; a second transfer section 20 that collectively transfers (second-transfers) the superimposed toner images transferred onto the intermediate transfer belt 15 to a paper sheet K, which is a recording medium; and a fixing device 60 that fixes the second-transferred images onto the paper sheet K. The image forming apparatus 100 further includes a controller 40 that receives and sends information from and to each device (each unit) to control the operation of the device (the unit).

A unit including the intermediate transfer belt 15, the first transfer sections 10, and the second transfer section 20 correspond to an example of the transfer device.

Each of the image forming units 1Y, 1M, 1C, and 1K of the image forming apparatus 100 includes a photoreceptor 11 that rotates in the direction of arrow A, the photoreceptor 11 serving as an example of the image carrier that holds a toner image formed on the surface.

A charger 12 that serves as an example of the charging device and that charges the photoreceptor 11 is disposed near the circumference of the photoreceptor 11. A laser exposure unit 13 that serves as an example of the latent image forming device and that writes an electrostatic latent image on the photoreceptor 11 is disposed above the photoreceptor 11 (in FIG. 4, an exposure beam is denoted by symbol Bm).

Near the circumference of the photoreceptor 11, a developing unit 14 that serves as an example of the developing device and that contains toner of a color component and visualizes the electrostatic latent image on the photoreceptor 11 with the toner is provided, and a first transfer roller 16 that transfers the toner image of the color component formed on the photoreceptor 11 onto the intermediate transfer belt 15 in the corresponding first transfer section 10 is provided.

The specific toner described above is used as at least one of toners of the color components. In the exemplary embodiment, all of the toners of the color components may each be the specific toner described above.

A photoreceptor cleaner 17 that removes the toner remaining on the photoreceptor 11 is further disposed near the circumference of the photoreceptor 11. Electrophotographic devices including the charger 12, the laser exposure unit 13, the developing unit 14, the first transfer roller 16, and the photoreceptor cleaner 17 are sequentially arranged in the rotation direction of the photoreceptor 11. The image forming units 1Y, 1M, 1C, and 1K are arranged in a substantially linear manner in the order of yellow (Y), magenta (M), cyan (C), and black (K) from the upstream side of the intermediate transfer belt 15.

The intermediate transfer belt 15 is driven in a circulatory manner (i.e., rotated) by various types of rollers at an intended speed in the direction B illustrated in FIG. 4. The various types of rollers include a driving roller 31 driven by a motor (not illustrated) to rotate the intermediate transfer belt 15, a support roller 32 that supports the intermediate transfer belt 15 extending in a substantially linear manner in the arrangement direction of the photoreceptors 11, a tension applying roller 33 that applies tension to the intermediate transfer belt 15 and that functions as a correction roller for reducing meandering of the intermediate transfer belt 15, a back roller 25 disposed in the second transfer section 20, and a cleaning back roller 34 disposed in a cleaning unit that scrapes off toner remaining on the intermediate transfer belt 15.

The first transfer section 10 is formed by the first transfer roller 16 serving as an opposite member that is disposed to face the photoreceptor 11 with the intermediate transfer belt 15 therebetween. The first transfer roller 16 includes a core and a sponge layer serving as an elastic layer adhering to the circumference of the core. The core is a solid-cylindrical rod made of a metal such as iron or SUS. The sponge layer is formed of a rubber blend of nitrile rubber (NBR), styrene-butadiene rubber (SBR), and ethylene-propylene-diene rubber (EPDM), the rubber blend containing an electrically conductive agent such as carbon black, and is a sponge-like cylindrical roller having a volume resistivity of $10^{7.5}$ Ω·cm or more and $10^{8.5}$ Ω·cm or less.

The first transfer roller 16 is disposed to be in pressure contact with the photoreceptor 11 with the intermediate transfer belt 15 therebetween. Furthermore, a voltage (first transfer bias) with a polarity opposite to the charge polarity of toner (negative polarity, the same applies hereinafter) is applied to the first transfer roller 16. Accordingly, the toner images on the photoreceptors 11 are sequentially electrostatically attracted to the intermediate transfer belt 15 to form toner images that are superimposed on the intermediate transfer belt 15.

The second transfer section 20 includes the back roller 25 and a second transfer roller 22 disposed on the toner-image holding surface side of the intermediate transfer belt 15.

The back roller 25 includes a surface portion formed of a tube made of a rubber blend of EPDM and NBR, the rubber blend containing carbon dispersed therein, and an inner portion made of EPDM rubber. The back roller 25 is formed so as to have a surface resistivity of $10^7$ Ω/square or more and $10^{10}$ Ω/square or less. The hardness of the back roller 25 is set to, for example, 70° (ASKER C manufactured by Kobunshi Keiki Co., Ltd., the same applies hereinafter). The back roller 25 is disposed on the back surface side of the intermediate transfer belt 15 and forms a counter electrode of the second transfer roller 22. A metallic power feed roller 26 to which a second transfer bias is stably applied is disposed in contact with the back roller 25.

The second transfer roller 22 includes a core and a sponge layer serving as an elastic layer adhering to the circumference of the core. The core is a solid-cylindrical rod made of a metal such as iron or SUS. The sponge layer is formed of a rubber blend of NBR, SBR, and EPDM, the rubber blend containing an electrically conductive agent such as carbon black, and is a sponge-like cylindrical roller having a volume resistivity of $10^{7.5}$ Ω·cm or more and $10^{8.5}$ Ω·cm or less.

The second transfer roller 22 is disposed to be in pressure contact with the back roller 25 with the intermediate transfer belt 15 therebetween. Furthermore, the second transfer roller 22 is grounded, and the second transfer bias is formed between the second transfer roller 22 and the back roller 25. The toner images are second-transferred onto a paper sheet (an example of the recording medium) K transported to the second transfer section 20.

An intermediate transfer belt cleaner 35 is disposed downstream of the second transfer section 20 so as to be separable from the intermediate transfer belt 15. The intermediate transfer belt cleaner 35 removes toner and paper powder remaining on the intermediate transfer belt 15 after the second transfer to clean the surface of the intermediate transfer belt 15.

The intermediate transfer belt 15, the first transfer sections 10 (first transfer rollers 16), and the second transfer section 20 (second transfer roller 22) correspond to an example of a transfer unit.

A reference sensor (home position sensor) 42 that generates a reference signal used as a reference for taking image formation timings in the image forming units 1Y, 1M, 1C, and 1K is disposed upstream of the yellow image forming unit 1Y. An image density sensor 43 for adjusting image quality is disposed downstream of the black image forming unit 1K. The reference sensor 42 generates the reference signal upon recognizing a mark provided on the back side of the intermediate transfer belt 15. The controller 40 sends instructions based on the recognition of the reference signal, and the image forming units 1Y, 1M, 1C, and 1K start forming an image in accordance with the instructions.

The image forming apparatus according to the present exemplary embodiment further includes, as a transport unit that transports a paper sheet K, a paper sheet container 50 that contains paper sheets K; a paper feed roller 51 that picks up and transports the paper sheets K stacked in the paper sheet container 50 at predetermined timing; transport rollers 52 that transport each paper sheet K drawn by the paper feed roller 51; a transport guide 53 that feeds the paper sheet K transported by the transport rollers 52 to the second transfer section 20; a transport belt 55 that transports, to the fixing device 60 (an example of a fixing unit), the paper sheet K transported after second transfer by the second transfer roller 22; and a fixing inlet guide 56 that guides the paper sheet K to the fixing device 60.

The controller 40 is configured as a computer that controls the overall apparatus and performs various operations. Specifically, the controller 40 includes, for example, a central processing unit (CPU), a read only memory (ROM) that stores various programs, a random access memory (RAM) used as a work area during execution of a program, a nonvolatile memory that stores various types of information, and an input-output interface (I/O) (all not illustrated). The CPU, the ROM, the RAM, the nonvolatile memory, and the I/O are connected to one another via a bus.

The image forming apparatus 100 further includes, in addition to the controller 40, for example, an operation display unit, an image processing unit, an image memory, a storage unit, and a communication unit (all not illustrated). The operation display unit, the image processing unit, the image memory, the storage unit, and the communication unit are connected to the I/O of the controller 40. The controller 40 receives and sends information from and to the operation display unit, the image processing unit, the image memory, the storage unit, and the communication unit to control these units.

Next, a basic image forming process of the image forming apparatus according to the present exemplary embodiment will be described.

In the image forming apparatus 100 illustrated in FIG. 4, image data output from, for example, an unillustrated image reader or personal computer (PC) is subjected to image processing in an unillustrated image processing device, and image forming operations are then performed in the image forming units 1Y, 1M, 1C, and 1K.

In the image processing device, the input reflectance data is subjected to various types of image processing such as shading correction, misregistration correction, lightness/color space conversion, gamma correction, frame deletion, and various types of image editing such as color editing and move editing. The image data that has been subjected to the image processing is converted into four types of colorant gradation data including Y color data, M color data, C color data, and K color data and output to the respective laser exposure units 13.

In each of the laser exposure units 13, the photoreceptor 11 of a corresponding one of the image forming units 1Y, 1M, 1C, and 1K is irradiated with an exposure beam Bm emitted from, for example, a semiconductor laser in accordance with the input colorant gradation data. In each of the image forming units 1Y, 1M, 1C, and 1K, the surface of the photoreceptor 11 is charged by the charger 12 and is then scanned and exposed with the laser exposure unit 13, and an electrostatic latent image is thereby formed. The formed electrostatic latent images are developed as Y, M, C, and K color toner images in the image forming units 1Y, 1M, 1C, and 1K, respectively.

The toner images formed on the photoreceptors 11 of the image forming units 1Y, 1M, 1C, and 1K are transferred onto the intermediate transfer belt 15 in the first transfer sections 10 in which the photoreceptors 11 come into contact with the intermediate transfer belt 15. More specifically, in each of the first transfer sections 10, a voltage (first transfer bias) with a polarity opposite to the charge polarity (negative polarity) of the toner is applied by the first transfer roller 16 to a substrate of the intermediate transfer belt 15. The toner images are thereby sequentially superimposed onto the surface of the intermediate transfer belt 15 so as to perform the first transfer.

After the toner images are sequentially first-transferred onto the surface of the intermediate transfer belt 15, the intermediate transfer belt 15 moves, and the toner images are transported toward the second transfer section 20. When the toner images are transported toward the second transfer section 20, in the transport unit, the paper feed roller 51 starts rotating at the timing of transportation of the toner images toward the second transfer section 20 to feed a paper sheet K with an intended size from the paper sheet container 50. The paper sheet K fed by the paper feed roller 51 is transported by the transport rollers 52 and reaches the second transfer section 20 through the transport guide 53. Before the paper sheet K reaches the second transfer section 20, the paper sheet K is temporarily stopped. A registration roller (not illustrated) starts rotating at a timing in synchronization with the movement of the intermediate transfer belt 15 on which the toner images are held, and the position of the paper sheet K is thereby aligned with the position of the toner images.

In the second transfer section 20, the second transfer roller 22 is pressed against the back roller 25 with the intermediate transfer belt 15 interposed therebetween. In this case, the paper sheet K transported at the appropriate timing is inserted between the intermediate transfer belt 15 and the second transfer roller 22. Here, when a voltage (second transfer bias) with the same polarity as the charge polarity (negative polarity) of the toner is applied from the power feed roller 26, a transfer electric field is formed between the second transfer roller 22 and the back roller 25. The unfixed toner images held on the intermediate transfer belt 15 are thereby electrostatically transferred onto the paper sheet K collectively in the second transfer section 20 in which the intermediate transfer belt 15 is pressurized by the second transfer roller 22 and the back roller 25.

The paper sheet K on which the toner images have been electrostatically transferred is then released from the intermediate transfer belt 15 and transported as it is by the second transfer roller 22 to the transport belt 55 disposed downstream of the second transfer roller 22 with respect to the transport direction of the paper sheet. The transport belt 55 transports the paper sheet K to the fixing device 60 at an optimal transport speed for the fixing device 60. The unfixed toner images on the paper sheet K transported to the fixing device 60 are subjected to fixing processing with heat and pressure by the fixing device 60 and thereby fixed onto the paper sheet K. The paper sheet K on which the fixed image has been formed is transported to a discharged sheet container (not illustrated) disposed in a discharge unit of the image forming apparatus.

After completion of transfer to the paper sheet K, the toner remaining on the intermediate transfer belt 15 is transported to the cleaning unit by the rotation of the intermediate transfer belt 15 and is removed from the intermediate transfer belt 15 by the cleaning back roller 34 and the intermediate transfer belt cleaner 35.

As a result of the steps described above, an image is formed on the paper sheet K serving as a recording medium by the image forming apparatus 100.

EXAMPLES

The present exemplary embodiment will now be specifically described by way of Examples. The present exemplary embodiment is not limited to the following Examples.

Production of Endless Belt

Example 1

Metal Substrate

An endless-shaped SUS substrate having a thickness of 50 μm, an inner diameter of 30 mm, and a length of 360 mm is prepared as a metal substrate. The SUS substrate has a thermal conductivity of 40 W/mK.

Formation of Heat-Resistant Resin Layer

Carbon nanotubes (CNT) (VGCF-H, manufactured by SHOWA DENKO K.K., average outer diameter: 150 nm, average length: 6 μm, aspect ratio: 40, thermal conductivity: 1,200 W/mK) are prepared as a thermally conductive filler.

To an N-methyl-2-pyrrolidone (NMP) solution (solid component concentration: 22% by mass) of a polyamic acid formed of 3,3',4,4'-biphenyltetracarboxylic dianhydride and 4,4'-diaminodiphenyl ether, 14 parts by mass of the carbon nanotubes are added relative to 100 parts by mass of the solid resin component. The mixture is subjected to mixing and coarse dispersion in a planetary mixer (AICOHSHA MFG. CO., LTD.) and subjected to dispersion treatment with a jet mill to prepare a heat-resistant resin layer-forming coating liquid 1.

While the metal substrate is rotated, the heat-resistant resin layer-forming coating liquid 1 is applied, by spiral coating, to an inner peripheral surface of the metal substrate. Regarding coating conditions, the rotational speed of the metal substrate is 100 (unit: rpm), and the travelling speed of a discharge unit in the rotational axis direction of the metal substrate is 1,000 (unit: mm/s). The amount of heat-resistant resin layer-forming coating liquid discharged per unit time is 1.5 (unit: g/10 s) at an end of the metal substrate in the rotational axis direction. The amount discharged per unit time is gradually decreased from the end toward a central portion and is 0.8 (unit: g/10 s) at the central portion.

Subsequently, while the metal substrate is held horizontally, the resulting coating film is dried by heating at 140° C. for 30 minutes and then heated at 320° C. for one hour to perform imidization of the polyamic acid.

As described above, a heat-resistant resin layer that includes polyimide as a resin and carbon nanotubes as a thermally conductive filler is formed.

Table 1 shows, regarding the obtained heat-resistant resin layer, the orientation ratio (circumferential direction) A of the thermally conductive filler ("Orientation ratio A Circumference" in Table 1), the orientation ratio (width direction) B of the thermally conductive filler ("Orientation ratio B Width" in Table 1), the average thickness, the thickness at the central portion in the width direction of the endless belt ("Thickness at center" in Table 1), the thickness at the end in the width direction of the endless belt ("Thickness at end" in Table 1), the arithmetical mean roughness Ra on the inner peripheral surface in the width direction of the endless belt, and the mean spacing Sm of irregularities on the inner peripheral surface in the width direction of the endless belt.

Formation of Elastic Layer and Release Layer

A liquid silicone rubber (KE1940-35, liquid silicone rubber 35-degree product, manufactured by Shin-Etsu Chemical Co., Ltd.) whose hardness specified by JIS type A has been adjusted to 35 degrees is applied to an outer peripheral surface of the metal substrate so as to have a thickness of 200 μm and dried to form an elastic layer.

Next, a PFA dispersion (a dispersion liquid of a tetrafluoroethylene-perfluoroalkyl vinyl ether copolymer, 500 cL, manufactured by Chemours-Mitsui Fluoroproducts Co., Ltd.) is applied to an outer peripheral surface of the obtained elastic layer so as to have a thickness of 30 μm and baked at 380 degrees to form a release layer.

As described above, an endless belt 1 is obtained.

Example 2

An endless belt 2 is obtained as in Example 1 except that, in the formation of the heat-resistant resin layer, the coating conditions of the heat-resistant resin layer-forming coating liquid are as follows. The rotational speed of the metal substrate is 60 (unit: rpm), and the travelling speed of the discharge unit in the rotational axis direction of the metal substrate is 800 (unit: mm/s). The amount of heat-resistant resin layer-forming coating liquid discharged per unit time is 1.5 (unit: g/10 s) at an end of the metal substrate in the rotational axis direction.

The amount discharged per unit time is gradually decreased from the end toward a central portion and is 0.8 (unit: g/10 s) at the central portion.

Example 3

An endless belt 3 is obtained as in Example 1 except that, in the preparation of the heat-resistant resin layer-forming coating liquid, the carbon nanotubes are added in an amount of 20 parts by mass relative to 100 parts by mass of the solid resin component.

Example 4

An endless belt 4 is obtained as in Example 1 except that, in the preparation of the heat-resistant resin layer-forming coating liquid, the carbon nanotubes are added in an amount of 10 parts by mass relative to 100 parts by mass of the solid resin component.

Example 5

An endless belt 5 is obtained as in Example 1 except that, in the preparation of the heat-resistant resin layer-forming coating liquid, carbon nanotubes (CNT) (VGCF-S, manufactured by SHOWA DENKO K.K., average outer diameter: 80 nm, average length: 100 μm, aspect ratio: 1,250, thermal conductivity: 1,000 W/mK) are used as a thermally conductive filler.

Example 6

An endless belt 6 is obtained as in Example 1 except that, among the coating conditions of the heat-resistant resin layer-forming coating liquid in the formation of the heat-resistant resin layer, the amount of heat-resistant resin layer-forming coating liquid discharged per unit time is constant at 1.6 (unit: g/10 s) from an end toward a central portion of the metal substrate in the rotational axis direction.

Comparative Example 1

An endless belt C1 is obtained as in Example 1 except that, in the formation of the heat-resistant resin layer, the heat-resistant resin layer-forming coating liquid 1 described above is used, and the metal substrate is pulling out in the axial direction thereof by a dip coating method to thereby apply the heat-resistant resin layer-forming coating liquid 1 to the inner peripheral surface of the metal substrate.

Comparative Example 2

An endless belt C2 is obtained as in Example 1 except that, carbon nanotubes are not added in the preparation of the heat-resistant resin layer-forming coating liquid.

Evaluation of Endless Belt

Thermal Conductive Property on Inner Peripheral Surface of Endless Belt

For each of the endless belts obtained as described above, the thermal conductivity on the inner peripheral surface of the endless belt (that is, the thermal conductivity of the whole of the heat-resistant resin layer) is measured with a thermal conductivity analyzer (ai-Phase Mobile, manufactured by ai-Phase Co., Ltd.) by an alternating-current steady method in accordance with ISO 22007-6. A larger value of the thermal conductivity determined by the measurement means a higher thermal conductive property on the inner peripheral surface of the endless belt. The results are shown in Table 1.

Sliding Resistance on Inner Peripheral Surface of Endless Belt

The obtained endless belt is placed on a stage heated to 150° C. in a friction and wear tester (FPR-2100, manufactured by RHESCA CO., LTD.) such that the inner peripheral surface of the endless belt comes in contact with a pin (material: SUS). Three conditions are set such that a load of 10 g, 20 g, or 30 g is applied. For each of the loads, a dynamic friction coefficient is measured by a linear reciprocating sliding measurement method at a measuring length of 50 mm and a measuring speed of 25 mm/sec, and the average is determined. A smaller average value of the dynamic friction coefficients determined by the measurement means that the sliding resistance on the inner peripheral surface of the endless belt is further reduced. The results are shown in Table 1.

TABLE 1

| | | Example 1 | Example 2 | Example 3 | Example 4 | Example 5 | Example 6 | Comparative Example 1 | Comparative Example 2 |
|---|---|---|---|---|---|---|---|---|---|
| Heat-resistant resin layer | Orientation ratio A Circumference (%) | 60 | 50 | 60 | 60 | 60 | 60 | 5 | 0 |
| | Orientation ratio B Width | 40 | 50 | 40 | 40 | 40 | 40 | 93 | 0 |

TABLE 1-continued

| | | Example 1 | Example 2 | Example 3 | Example 4 | Example 5 | Example 6 | Comparative Example 1 | Comparative Example 2 |
|---|---|---|---|---|---|---|---|---|---|
| (%) | | | | | | | | | |
| | Average thickness (μm) | 6.1 | 7.3 | 6.2 | 6.3 | 6.3 | 7.3 | 6.1 | 6.1 |
| | Thickness at center (μm) | 3.2 | 4.1 | 3.3 | 3.0 | 3.2 | 7.2 | 3.2 | 3.3 |
| | Thickness at end (μm) | 8.2 | 9.0 | 8.0 | 8.2 | 9.1 | 7.3 | 8.5 | 8.4 |
| | Ra (μm) | 0.21 | 0.31 | 0.40 | 0.15 | 0.26 | 0.20 | 0.22 | 0.11 |
| | Sm (μm) | 300 | 390 | 201 | 404 | 340 | 302 | 310 | 450 |
| Evaluation | Thermal conductivity (W/mK) | 0.88 | 0.89 | 1.12 | 0.71 | 0.97 | 0.88 | 0.41 | 0.21 |
| | Dynamic friction coefficient | 0.50 | 0.49 | 0.41 | 0.55 | 0.48 | 0.51 | 0.78 | 0.89 |

It is found that the endless belts produced in Examples have high thermal conductive properties on the inner peripheral surfaces thereof while having reduced sliding resistances on the inner peripheral surfaces compared with the endless belts produced in Comparative Examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An endless belt comprising:

a metal substrate; and a heat-resistant resin layer that is disposed as an innermost layer on an inner peripheral surface of the metal substrate and that contains a resin and a thermally conductive filler having an aspect ratio of 20 or more, wherein an orientation ratio of the thermally conductive filler with respect to a circumferential direction of the endless belt is 20% or more.

2. An endless belt comprising:

a metal substrate; and a heat-resistant resin layer that is disposed as an innermost layer on an inner peripheral surface of the metal substrate and that contains a resin and a thermally conductive filler having an aspect ratio of 20 or more, wherein, on an inner peripheral surface of the heat-resistant resin layer, an arithmetical mean roughness Ra is 0.01 μm or more and 1.2 μm or less, and a mean spacing Sm of irregularities is 10 μm or more and 500 μm or less in a width direction of the endless belt.

3. The endless belt according to claim 1, wherein the thermally conductive filler is a carbon-based filler.

4. The endless belt according to claim 2, wherein the thermally conductive filler is a carbon-based filler.

5. The endless belt according to claim 3, wherein the carbon-based filler is a carbon nanotube.

6. The endless belt according to claim 4, wherein the carbon-based filler is a carbon nanotube.

7. The endless belt according to claim 1, wherein a thermal conductivity ratio (metal substrate/thermally conductive filler) of a thermal conductivity of the metal substrate to a thermal conductivity of the thermally conductive filler is 1/100 or more and 1/3 or less.

8. The endless belt according to claim 2, wherein a thermal conductivity ratio (metal substrate/thermally conductive filler) of a thermal conductivity of the metal substrate to a thermal conductivity of the thermally conductive filler is 1/100 or more and 1/3 or less.

9. The endless belt according to claim 3, wherein a thermal conductivity ratio (metal substrate/thermally conductive filler) of a thermal conductivity of the metal substrate to a thermal conductivity of the thermally conductive filler is 1/100 or more and 1/3 or less.

10. The endless belt according to claim 4, wherein a thermal conductivity ratio (metal substrate/thermally conductive filler) of a thermal conductivity of the metal substrate to a thermal conductivity of the thermally conductive filler is 1/100 or more and 1/3 or less.

11. The endless belt according to claim 5, wherein a thermal conductivity ratio (metal substrate/thermally conductive filler) of a thermal conductivity of the metal substrate to a thermal conductivity of the thermally conductive filler is 1/100 or more and 1/3 or less.

12. The endless belt according to claim 6, wherein a thermal conductivity ratio (metal substrate/thermally conductive filler) of a thermal conductivity of the metal substrate to a thermal conductivity of the thermally conductive filler is 1/100 or more and 1/3 or less.

13. The endless belt according to claim 7, wherein the thermal conductivity of the thermally conductive filler is 200 W/mK or more and 1,500 W/mK or less.

14. The endless belt according to claim 8, wherein the thermal conductivity of the thermally conductive filler is 200 W/mK or more and 1,500 W/mK or less.

15. The endless belt according to claim 9, wherein the thermal conductivity of the thermally conductive filler is 200 W/mK or more and 1,500 W/mK or less.

16. The endless belt according to claim 10, wherein the thermal conductivity of the thermally conductive filler is 200 W/mK or more and 1,500 W/mK or less.

17. The endless belt according to claim 1, wherein an orientation ratio of the thermally conductive filler with respect to a width direction of the endless belt is 20% or more and 80% or less.

18. The endless belt according to claim 1, wherein a thickness of the heat-resistant resin layer is gradually increased from a central portion toward an end in a width direction of the endless belt.

19. A fixing device comprising:

a first rotatable body formed of the endless belt according to claim 1;

a second rotatable body disposed in contact with an outer peripheral surface of the first rotatable body; and a pressing member that is disposed inside the first rotatable body and that presses the first rotatable body from an inner peripheral surface of the first rotatable body against the second rotatable body.

20. An image forming apparatus comprising:

an image carrier;

a charging device that charges a surface of the image carrier;

a latent image forming device that forms a latent image on the charged surface of the image carrier;

a developing device that develops the latent image with toner to form a toner image;

a transfer device that transfers the toner image to a recording medium; and the fixing device according to claim 19, wherein the fixing device fixes the toner image to the recording medium.

* * * * *